US006457495B1

(12) United States Patent
Meheen

(10) Patent No.: US 6,457,495 B1
(45) Date of Patent: Oct. 1, 2002

(54) FILLING APPARATUS AND METHODS

(76) Inventor: Dave Meheen, 325 N. Oregon Ave., Pasco, WA (US) 99301

( * ) Notice: Subject to any disclaimer, the term of this patent is extended or adjusted under 35 U.S.C. 154(b) by 0 days.

(21) Appl. No.: 09/823,774

(22) Filed: Mar. 31, 2001

(51) Int. Cl.[7] ..... B65B 1/04
(52) U.S. Cl. ..... 141/40; 141/48; 141/49
(58) Field of Search ..... 141/37, 39–50, 141/285–302

(56) References Cited

U.S. PATENT DOCUMENTS 3,757,835 A * 9/1973 Copping ..... 141/286
4,442,873 A * 4/1984 Yun ..... 141/183
5,054,527 A * 10/1991 Rozier ..... 141/147
5,501,253 A * 3/1996 Weiss ..... 141/198
6,112,780 A 9/2000 Meheen

* cited by examiner

*Primary Examiner*—Steven O. Douglas
(74) *Attorney, Agent, or Firm*—John S. Reid; Reidlaw, L.L.C.

(57) ABSTRACT

Methods and apparatus for filling a container with a liquid product. The apparatus includes various passageways which facilitate the evacuation of the container of atmospheric gases prior to filling as well as facilitating introduction of the liquid product into the container. The apparatus also allows for the introduction of a counter-pressure purge gas to be introduced into the container after evacuation to prevent reintroduction of atmospheric gases into the container during filling of the container with a fluid product. A method in accordance with the instant invention comprises substantially evacuating the container as well as introducing liquid product into the container.

14 Claims, 9 Drawing Sheets

FILLING APPARATUS AND METHODS

FIELD OF THE INVENTION

This invention pertains to apparatus for, and methods of, filling containers with fluid.

BACKGROUND OF THE INVENTION

Various types of prior art filling apparatus and methods are employed for filling containers, such as bottles and the like, with consumable liquid products. Such liquid products can include carbonated beverages such as soda and beer, as well as non-carbonated beverages such as milk-based products, juices, and wine. Typically, containers comprising glass bottles are filled with a beverage liquid product after which the bottles are sealed with a bottle cap or the like.

Often, a concern is posed by the potential for the presence of atmospheric gases, and oxygen in particular, within the bottle after the bottle is filled and sealed. The presence of such atmospheric gases within the bottle after the bottle is filled and sealed can tend to facilitate relatively rapid degradation of liquid products, and particularly beer. In some cases, such as in the case of beer, it can be most preferable to avoid contact of the beer liquid product with atmospheric gasses at anytime during the brewing and filling operation. That is, at least in the case of beer, it is most preferable to prevent the contact of the beer with any atmospheric gases, and oxygen in particular, during the bottling process. It is additionally preferable to exclude atmospheric gases, and oxygen in particular, from the container which holds the beer.

In addition to preventing contact of the liquid beverage product with atmospheric gases, such as oxygen, it is also often desirable to prevent foaming, or any unnecessary agitation, of the liquid product during the bottling thereof, at least to the extent feasible. This is because excessive foaming or agitation of the liquid beverage product can result in the separation of desirable gases which are dissolved within the liquid product. For example, beer often contains dissolved carbon dioxide which adds desirable qualities thereto, and which provides other benefits. Excessive agitation of beer during bottling can cause problems in the filling operation due to the excessive formation of foam, and can cause a decrease in the quality of the beer liquid product.

A great degree of effort has been expended toward developing prior art filling methods and apparatus which would theoretically both avoid exposure of the beverage liquid product with atmospheric gases and minimize agitation of the product during filling operations. Examples of such methods and apparatus are set forth in U.S. Pat. No. 6,912,780 to Meheen. In accordance with the '780 patent, both a three-tube embodiment and a four-tube embodiment of a filling apparatus are disclosed.

Referring to FIG. 3 of the '780 patent which is substantially reproduced in the drawings which accompany the instant application as Prior Art FIG. 1, a side elevation schematic diagram of a prior art three-tube filling apparatus 11 in accordance with a first embodiment of the invention of the '780 patent is shown. The prior art filling apparatus 11 is employed for dispensing a liquid product 5, such as a beverage, into a product container 3 such as a bottle or the like. The prior art filling apparatus 11 comprises a fill tube 17, a purge tube 23, and an off-gas tube 35 as shown.

The tubes 17, 23, 35 are supported by a filling head 30. A sealing gasket 9 is also supported by the filling head 30 and is configured to provide a seal between the lip 7 of the bottle 3 and the filling head. The off-gas tube 35 is connected to a moisture separator 607 by way of an off-gas control valve 21. In addition, a control unit 43 is employed to control various operational functions of the filling apparatus 11, such as the operation of the valve 21.

Now referring to FIG. 2 of the '780 patent, which is substantially reproduced in the drawings which accompany the instant application as Prior Art FIG. 2, a sequence 10 of operational steps "A" through "I" is shown. The sequence 10 of operational steps substantially corresponds to one possible operational scheme of the prior art three-tube filling apparatus 11 described above. Referring to both FIGS. 1 and 2 of the instant application, the operation of the prior art filling apparatus 11 begins with the operational step "A" wherein the bottle, or container, 3 is positioned in preparation for filling thereof. The next step in the sequence 10 is the operational step "B" in accordance with which the filling apparatus, or assembly, 11 is to be lowered into the container 3.

In accordance with step "C" of the sequence 10, a purge operation is initiated before the filling apparatus 11 is fully lowered into the bottle 3. The purge operation, in accordance with step "C," comprises introducing an inert gas 13 into the purge tube 23 in an effort to drive atmospheric gas from the bottle .3. Step "D" is the next step of the sequence 10, in accordance with which the off-gas control valve 21 is opened. Moving to step "E" which is the next step of the sequence 10, the filling apparatus 11 is fully lowered into place as shown in FIG. 1 of the instant application.

Still referring to both FIGS. 1 and 2, a seal is established by way of the sealing gasket 9 between the filling apparatus 11 and the bottle 3 in accordance with step "F." Once the seal is established in accordance with step "F" the filling of the bottle 3 can commence by introduction of the liquid product 5 into the fill tube 17. The liquid product 5, by entering the bottle 3, displaces gas within the bottle which can escape through the off-gas tube 35. After the filling commences, the operational sequence 10 then progresses to step "G" in accordance with which the flow of gas out of the bottle 3 is restricted by way of the operation of the off-gas control valve 21.

The operational sequence 10 then progresses to step "H" in accordance with which filling of the bottle 3 is stopped. That is, in accordance with step "H" the flow of liquid product 5 into the bottle 3 ceases. The final step of the operational sequence 10 is step "I" which is an optional step. In accordance with step "I" a pulse of gas 51 can be introduced into the off-gas tube 35.

The pulse of gas 51 in accordance with step "I" can be employed to cause foaming of the liquid product 5 in the case wherein a gas, such as carbon dioxide, is dissolved within the liquid product, such as in the case of beer. The foaming of the liquid product 5 in accordance with the step "I" can cause the foam to displace the remaining atmospheric gas which is present within the bottle 3. After the step "I" the filling apparatus 11 can be removed from the bottle 3, whereupon the bottle can be capped or otherwise sealed.

Now referring to FIG. 6 of the '780 patent, which is substantially reproduced in the drawings which accompany the instant application as Prior Art FIG. 3, a side elevation schematic diagram of a four-tube filling apparatus 12 in accordance with a second embodiment of the invention of the '780 patent is shown. As is seen in FIG. 3, the prior art four-tube apparatus 12 of the '780 patent is similar to the three-tube embodiment in accordance therewith, which is described above, with the exception of the addition of a fourth tube 601 and a valve 605 connected thereto.

That is, the prior art four-tube filling apparatus 12 comprises a fill tube 17, a purge gas tube 23, an off-gas tube 35, and a fourth tube 601. The four tubes 17, 23, 35, 601 are supported by the filling head 30. The filling head 30 can be substantially sealed against a lip 7 of a container 3, such as a bottle or the like. The prior art filling apparatus 12 can be employed for filling the container 3 with a liquid product 5 such as a beverage or the like. The prior art filling apparatus 12 also comprises an off-gas control valve 21 as well as a valve 605. A control unit 43 is also included in the prior art four-tube apparatus 12 for controlling various operational functions of the apparatus, such as for controlling the operation of the valves 21, 605.

Turning now to FIG. 8 of the '780 patent, which is substantially reproduced in the drawings which accompany the instant application as Prior Art FIG. 4, a sequence 20 of operational steps "A" through "Q" is shown. The sequence 20 of operational steps substantially corresponds to one possible operational scheme of the prior art four-tube filling apparatus 12 which is described above.

Referring now to both FIGS. 3 and 4, the first step of the sequence 20 of operational steps is step "A" in accordance with which the bottle 3 is positioned relative to the filling apparatus 12 in preparation for filling the bottle. The sequence 20 then progresses to step "B" wherein the filling head 30 along with the tubes 17, 23, 35, 601 is lowered into the bottle 3. In accordance with step "C," which is the next step, the purge operation is commenced by introducing purge gas into the bottle via the purge tube 23.

Moving to step "D" the off-gas valve 21 is opened to allow gas 523 to escape from the bottle 3 via the off-gas tube 35. In accordance with step "E" the filling apparatus 12 is fully lowered into place on the bottle 3 as is shown in FIG. 3. Still referring to both FIGS. 3 and 4, in accordance with step "F" a seal is established between the filling head 30 and the lip 7 of the bottle 3 byway of the sealing gasket 9. The liquid product 5 can now begin to flow into the bottle 3 via the fill tube 17. Gas 523, which is displaced by the incoming liquid product 5, now escapes from the bottle 3 via the fourth tube 601 in accordance with step "J."

During the filling process, the flow of purge gas is restricted in accordance with step "K" of the sequence 20. Moving to step "L," the fill process is stopped when the desired level of liquid product 5 is established within the bottle 3. The valve 605 is then opened in accordance with step "M" to allow the internal pressure of the bottle 3 to decrease so as to approximately equal the external, atmospheric pressure. That is, in accordance with step "M," pressure which remains within the bottle 3 after the filling process is stopped is released via the fourth tube 601.

Moving now to step "N," an optional pressure pulse gas 51 can be applied to the interior of the bottle 3 via the off-gas tube 35. If such a pulse is performed, the pulse gas 51 is released from the bottle 3 via the fourth tube 601 in accordance with step "P." In accordance with the final step, which is step "Q," the filling apparatus 12 is removed from the bottle 3, whereupon the bottle is capped or otherwise sealed.

Thus, as is evident from the above discussion, the prior art three-tube apparatus 11, as well as the four-tube prior art apparatus 12, are configured to first introduce a purge gas into the liquid product container 3 prior to commencement of the introduction of the liquid beverage product thereto. The internal pressure of the bottle 3 then builds to a level that is greater than the external atmospheric pressure. The fill process then begins wherein the liquid product is introduced into the container 3.

The purge gas, as well as atmospheric gas remaining within the container 3, is displaced from the container by the incoming liquid product. When the liquid product reaches the desired level within the container 3, the fill process is stopped whereupon an optional pressure pulse can be applied to the interior of the bottle to cause foaming, or the like, of the liquid product. The pressure within the container is then substantially equalized with the external atmospheric pressure whereupon the filling apparatus 11, 12 is removed from the container 3, which is then capped or otherwise sealed.

SUMMARY OF THE INVENTION

The invention includes methods and apparatus for filling a container with a fluid. In accordance with a first embodiment of the present invention, an apparatus for filling a container comprises a fill portion, an off-gas portion, and a snift portion. The apparatus is configured to substantially seal the container from the atmosphere. The container can then be substantially evacuated when a vacuum is applied to the container by way of the snift portion. After substantial evacuation of the container, purge gas can be introduced into the container by way of the off-gas portion. Liquid product can be introduced into the container by way of the fill portion to displace the purge gas which is released from the container by way of the snift portion or the off-gas portion.

In accordance with a second embodiment of the present invention, an apparatus for filling a container comprises a fill portion, an off-gas portion, and a snift portion. The apparatus is configured to substantially seal the container from the atmosphere. The container can be substantially evacuated when a vacuum is applied to the container by way of the off-gas portion. Purge gas can be introduced into the container by way of the off-gas portion, and the liquid product can be introduced into the container by way of the fill portion to displace the purge gas which can be released by way of the snift portion or the off-gas portion.

In accordance with a third embodiment of the present invention, an apparatus for filling a container comprises a fill portion, an off-gas portion, and a snift portion. The apparatus is configured to substantially seal the container from the atmosphere. The container can be substantially evacuated when a vacuum is applied to the container by way of the off-gas portion. Purge gas can be introduced into the container by way of the snift portion, and the liquid product can be introduced into the container by way of the fill portion to displace the purge gas which can be released by way of the snift portion or the off-gas portion.

In accordance with a fourth embodiment of the present invention, an apparatus for filling a container comprises a fill portion, an off-gas portion, and a snift portion. The apparatus is configured to substantially seal the container from the atmosphere. The container can be substantially evacuated when a vacuum is applied to the container by way of the snift portion. Purge gas can be introduced into the container by way of the snift portion, and the liquid product can be introduced into the container by way of the fill portion to displace the purge gas which can be released by way of the snift portion or the off-gas portion.

In accordance with a fifth embodiment of the present invention, a method of filling a container comprises substantially evacuating the container and introducing liquid product into the container. The method can also include sealing the container from the atmosphere and counter-pressuring the container with purge gas.

DETAILED DESCRIPTION OF THE INVENTION

The invention includes apparatus and methods for filling a container with a liquid product. The various versions of the apparatus in accordance with various embodiments of the instant invention generally include a fill portion, an off-gas portion, and a snift portion. The apparatus are generally configured to seal an internal chamber of a container from the atmosphere before evacuating the chamber of substantially all atmospheric gases. A purge gas can then be introduced into the chamber of the container through either the off-gas portion or through the snift portion in accordance with respective embodiments of the instant invention. The purge gas can serve to prevent re-infiltration of atmospheric gases into the chamber. The liquid product can then be introduced into the container through the fill portion to displace some of the purge gas which can be released from the container in a controlled manner through either the off-gas portion or the snift portion.

Figure 1:
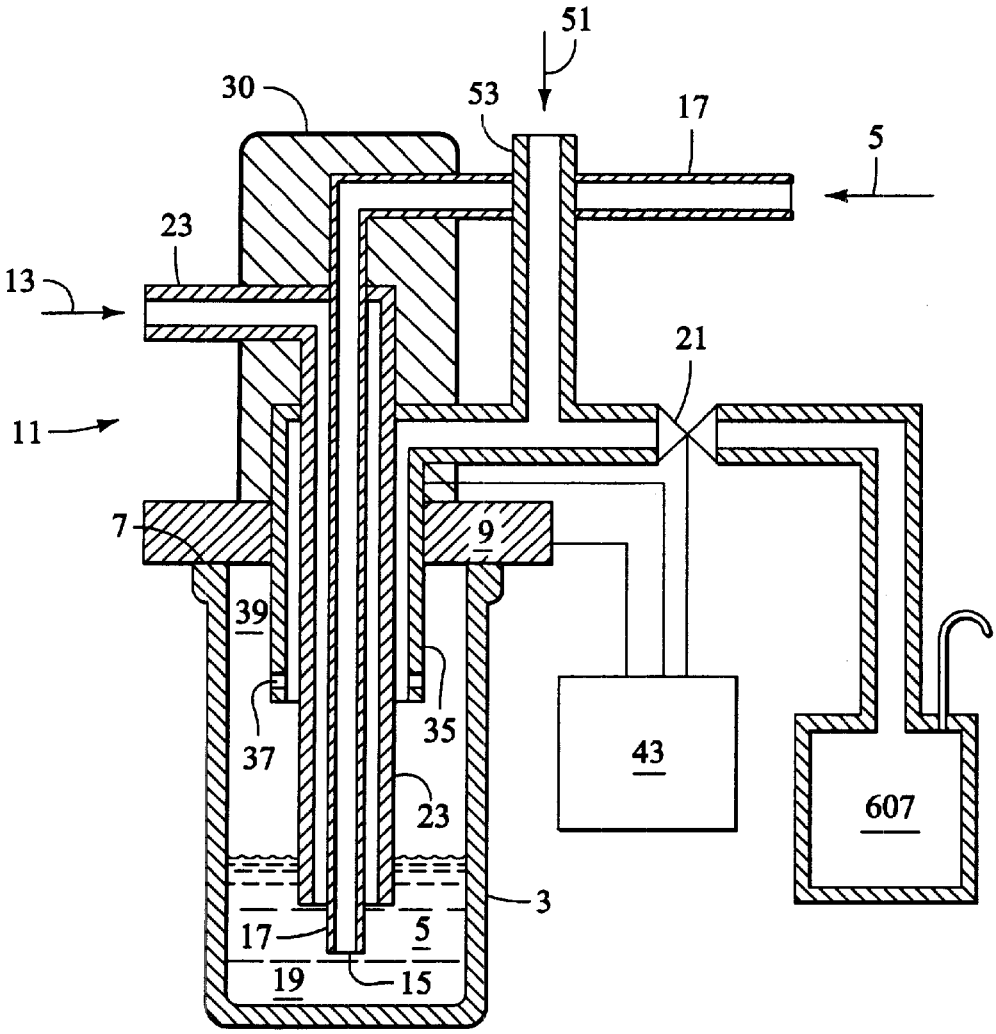
FIG.1 PRIOR ART
FIG. 1 is a side elevation schematic diagram of a prior art three-tube apparatus for filling a container with a liquid product.
Figure 2:
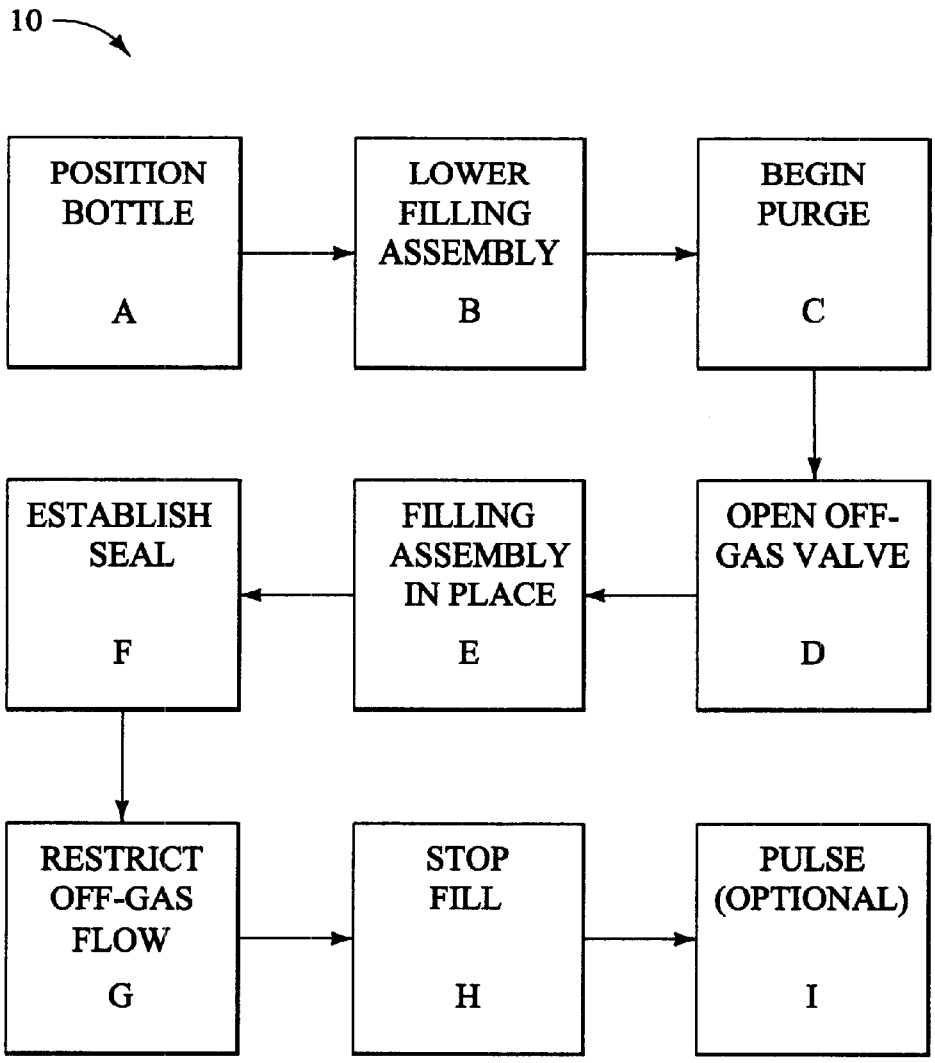
FIG.2 PRIOR ART
FIG. 2 is a prior art flow chart which represents a possible operational scheme for the apparatus depicted in FIG. 1.
Figure 3:
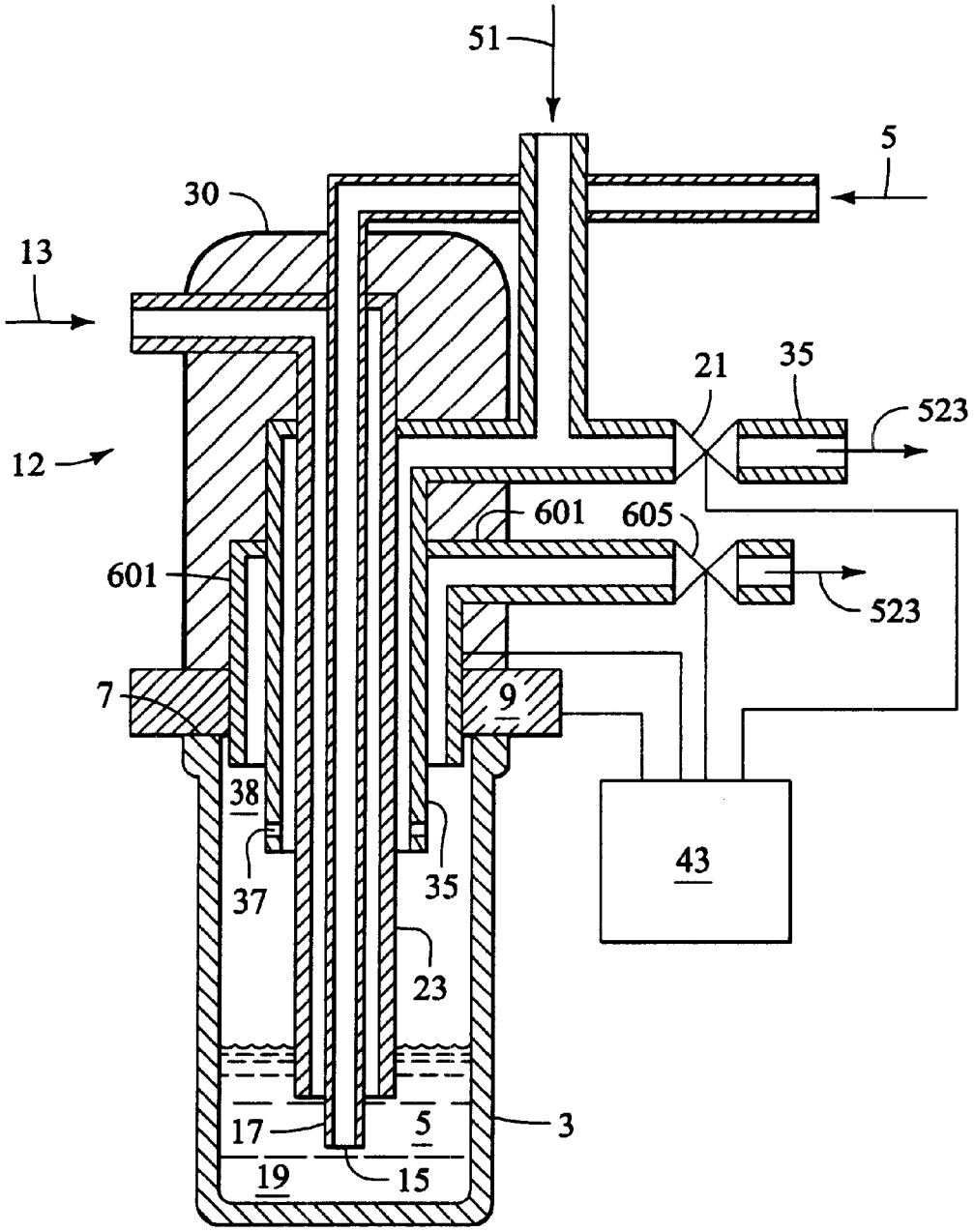
FIG.3 PRIOR ART
FIG. 3 is a side elevation schematic diagram of a prior art four-tube apparatus for filling a container with a liquid product.
Figure 4:
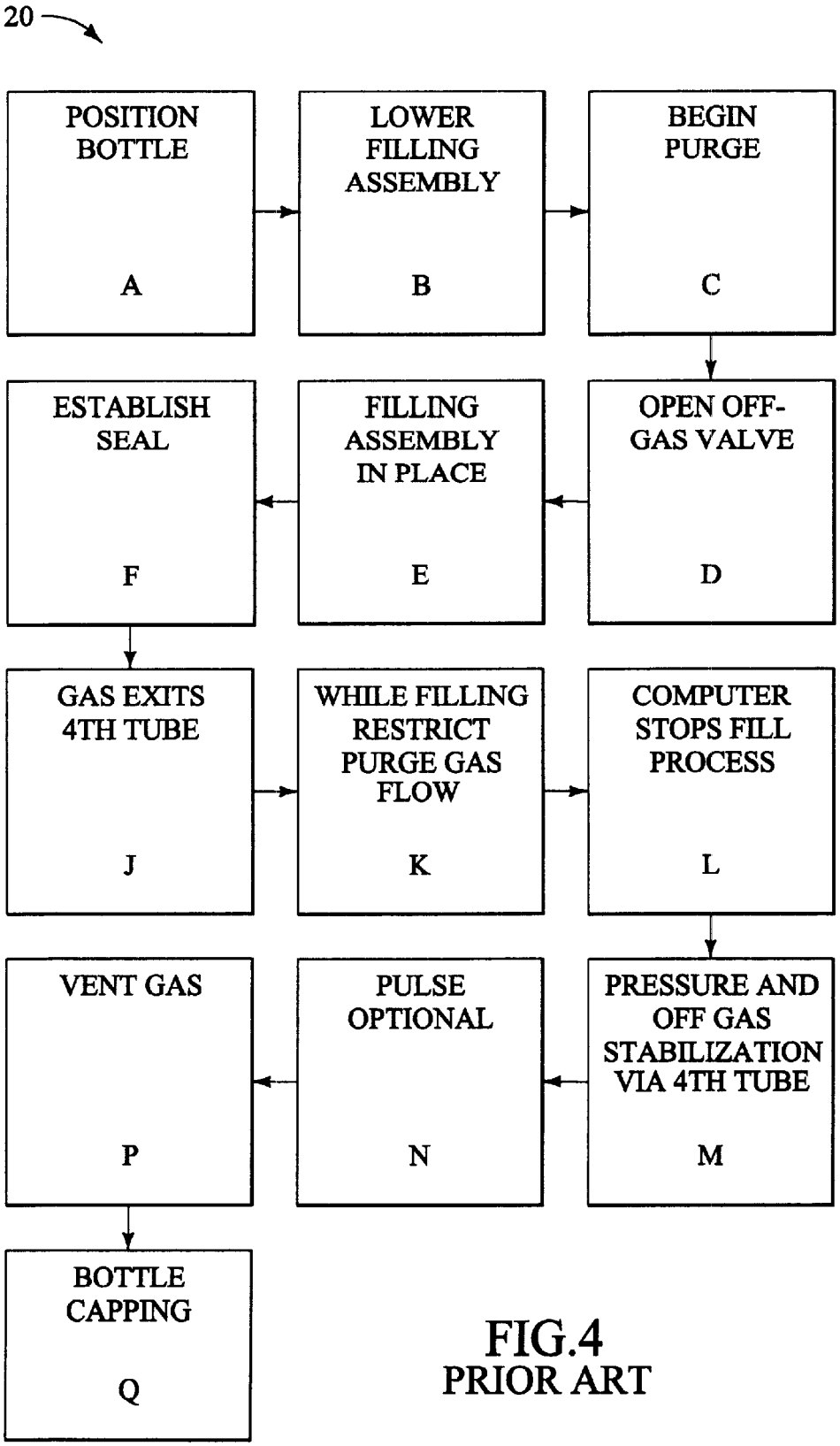
FIG.4 PRIOR ART
FIG. 4 is a prior art flow chart which represents a possible operational scheme for the apparatus depicted in FIG. 3.
Figure 5:
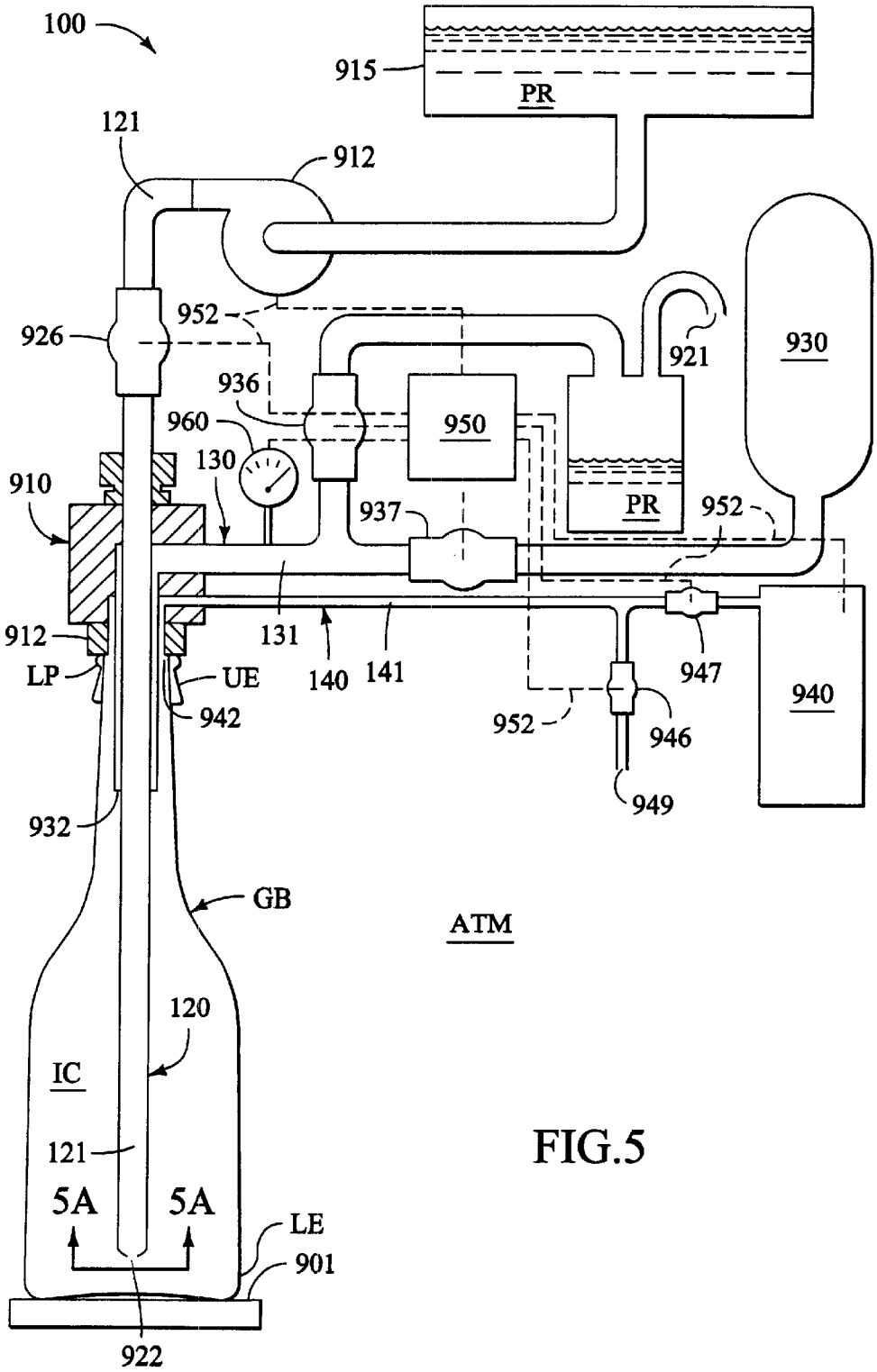
FIG. 5 is a side elevation schematic diagram of an apparatus for filling a container with liquid in accordance with a first embodiment of the present invention.

Turning to FIG. 5, a side elevation schematic diagram is shown of a filling apparatus 100 in accordance with a first embodiment of the present invention. The apparatus 100 is generally configured to fill a container "GB," such as a glass bottle or the like, with a liquid product "PR" such as a beverage. The container "GB" generally defines an internal chamber "IC" in which the liquid product "PR" is placed, or poured, by the filling apparatus 100. Preferably, the container "GB" is designed to withstand at least a given minimum internal/external pressure differential which will allow at least a partial vacuum to be applied to the internal cavity "IC."

More preferably, the container "GB" is of a design which is typically used within the bottling industry and which is designed to withstand an internal/external pressure differential of at least one atmosphere, or about 15 psi. This will allow the container "GB" to withstand a complete and total evacuation thereof, the relevance of which is apparent in the discussion below.

Typically, the apparatus 100 is configured to consecutively fill many such containers "GB" in conjunction with a continuous production line (not shown) or the like. The container "GB" preferably has an upper end "UE" and an opposite and distal lower end "LE" which is configured to rest on a support surface 901 such as a conveyor or the like so as to support the container in a substantially upright position as shown. The container "GB" preferably has a substantially annular lip "LP" proximate the upper end "UE" which defines an opening to the internal chamber "IC" of the container "GB."

The apparatus 100 can comprise a filling head 910 which is configured to support various portions of the filling apparatus as will be described in greater detail below. For example, the apparatus 100 can include a seal 912 which is supported on the filling head 910. The seal 912 is preferably configured to contact the lip "LP" of the container "GB" so as to form a substantially air tight seal between the container and the filling head 910 when the apparatus 100 is placed into a filling position relative to the container "GB." The filling position can be defined as the position of the filling head 910 relative to the container "GB" as depicted, wherein the process of filling the container can commence.

The apparatus 100 preferably also comprises an actuator or the like (not shown) which is employed so as to cause the container "GB" to move relative to the apparatus 100, or portion thereof, so as to facilitate the placement of the apparatus and container into, and out of, the filling position. Although the illustrative figures included herewith depict various embodiments of the instant invention in the filling position only, it is understood that, when the apparatus 100 is moved out of the filling position, no portion of the apparatus is located within the internal chamber "IC" of the container "GB" and the apparatus does not contact the container.

An actuator (not shown) as described above, can be included in the apparatus 100, wherein the actuator is preferably configured to move either the container "GB" or the filling head 910 so that the container and the filling head can be placed into, and out of, the filling position relative to one another. The actuator can comprise an elevator device (not shown) to lift the container "GB" into and out of the fill position. Alternatively, or in addition, the actuator can comprise a lift device (not shown) to place the filling head 910 into or out of the fill position by moving the fill head away from or toward the container.

The overall process of filling the container "GB" with a liquid product "PR" can comprise several related operations, each of which are carried out by one of several portions of the apparatus 100. More specifically, the apparatus 100 comprises a fill portion 120 that is configured to convey fluid between a liquid product reservoir 915, such as a tank or the like, and the internal chamber "IC" of the container "GB." When I say "fluid" I mean to include liquid fluid and gaseous fluid. The fill portion 120 can define a passageway 121 such as a duct or the like in which fluid can be conveyed. The fluid so conveyed by the fill portion 120 can be, for example, a liquid product "PR" such as beer.

Preferably, the fill passageway terminates at a fill opening 922 which is configured to fluidly communicate with the internal chamber "IC" of the container "GB" when the filling head 910 is in the fill position. When I say "fluidly communicate" with a given space or cavity, I mean exposed to the given space or cavity so as to be able to selectively transfer fluid into and out of the given cavity. The fill portion 120 is preferably configured so that the fill opening 922 is located within the internal chamber "IC" when the filling head 910 is in the fill position. More preferably, the fill portion is configured so that the fill opening is proximate the lower end "LE" of the container when the filling head 910 is in the fill position.

Additionally, the fill opening 922 is preferably a capillary opening. When I say "capillary opening" I mean the lower of two openings of a passageway, wherein the lower opening is of a cross-sectional area which is sufficiently small to cause the surface tension of a fluid within the passageway to prevent the fluid from draining out of the lower opening when the upper opening of the two openings is closed, but which cross-sectional area is sufficiently large to allow the fluid to drain from the lower opening when the upper opening is open.

For example, the lower opening of a drinking straw filled with water can be considered a capillary opening because, when the upper opening of the straw is blocked, or closed, the surface tension of the water within the drinking straw prevents the water from draining from the lower opening. However, when the upper opening of the drinking straw is unblocked, the water will easily drain from the lower opening.

Conversely, for example, the lower opening of an elongated pipe having a 4-inch inside diameter and being filled with water is not a capillary opening because the opening is too large to allow the surface tension of water within the pipe to prevent the water from draining from the lower opening. Determination of the appropriate cross-sectional area of any given opening in order to produce a capillary opening for a given fluid within the given passage will be obvious to one skilled in the art. Such a determination will depend on various characteristics of the given fluid such as the density, viscosity, surface tension properties and the like, of the given fluid.

Also, the fill passageway 121, with the exception of the fill opening 922, is preferably a laminar passage with respect to the fluid intended to be conveyed thereby. When I say "laminar passage" I mean a passage that is of sufficient cross-sectional area to convey a given fluid there through while allowing substantially laminar flow characteristics of the given fluid at operational fluid flow rates. The laminar flow characteristics provided by a laminar passage can serve to minimize unnecessary agitation of a fluid, such as the liquid product "PR," during filling operations. As in the case of a capillary opening as described above, determination of the appropriate cross-sectional area of any given passage in order to achieve the desired flow characteristics of a given fluid within the given passage will be obvious to one skilled in the art. Such a determination will depend on various characteristics of the given fluid such as the density and the viscosity, and the like, of the given fluid.

The fill portion 120 can also include at least one fill valve 926 which defines at least a portion of the fill passageway 121 and which is configured to regulate the flow of fluid there through. For example, the fill valve 926 can be configured to regulate the flow of fluid from the product reservoir 915 to the internal chamber "IC" of the container "GB." It is understood that the location of the fill valve 926 relative to the fill passageway 121 is not intended to be limited a given location such as that shown in accompanying figures. That is, the fill valve 926 can be located anywhere along the associated fill passageway wherein the fill valve can perform the function for which it is intended. It is understood that this applies to any valve which is described herein below. That is, any given valve can be located at any position relative to its associated passageway wherein such location enables the given valve to perform the function for which it was intended.

Moreover, when I say "valve" I mean a device that is configured with a mechanism to control the rate of fluid flow there through which mechanism can include a throttling means for limiting the cross sectional area of a passageway, such as in the case of a throttling valve, and which mechanism can also include pressure regulating means for allowing fluid to flow only above a given fluid pressure, such as in the case of a pressure regulating valve. The term "valve" can also include a device which is configured to prevent any fluid flow there through such as in the case of a fully closed throttling valve.

The fill portion 120 can also include a pump 912 for inducing fluid flow within the fill portion. When I say "pump" I mean any device that is configured to induce fluid flow within a passageway. As is seen in FIG. 5, the fill portion 120 can be at least partially supported by the filling head 910. Although not shown, it is understood that the fill portion 120 can comprise substantially flexible tubing or the like, or flexible joints, in order to facilitate movement of the filling head 910 along with part of the fill portion 120 supported thereby while allowing the remainder of the fill portion which is not supported by the filling head to remain substantially stationary relative to the filling head. It is understood that other portions of the apparatus 100 which are described below can also be similarly configured.

The apparatus 100 also comprises an off-gas portion 130 that is configured to convey fluid substantially between the internal chamber "IC" of the container "GB" and a liquid trap 920. The liquid trap 920 is a device that substantially captures and holds liquid material therein while allowing gaseous material to pass through as will be discussed below. The off-gas portion 130 can define an off-gas passageway 131 such as a duct or the like in which liquid and gas can be conveyed. Preferably, the off-gas passageway 131 terminates at an off-gas opening 932. More preferably, the off-gas opening 932 is configured to fluidly communicate with the internal chamber "IC" of the container "GB" when the filling head 910 is in the fill position.

As a study of FIG. 5 will reveal, liquid fluid material that enters the liquid trap 920 by way of the off-gas portion 130 will be captured and held in the liquid trap while gaseous fluid material so entering the liquid trap will substantially pass there through and exit the liquid trap by way of a trap vent opening 921 to the atmosphere "ATM." When I say "atmosphere" I mean air space which is external to the container "GB" and which air space is at substantially atmospheric pressure. The off-gas portion 130 can include at least one off-gas valve 936 which defines at least a portion of the off-gas passageway 131 and which is configured to regulate the flow of flow of fluid there through. For example, the off-gas valve 936 can be configured to regulate the flow of fluid from the off-gas passageway 131 into the liquid trap 920.

As further evidenced by FIG. 5, the off-gas passageway 131 can branch out in two or more directions so as to have several "legs." Specifically, the off-gas passageway 131 of the apparatus 100 can be configured to branch so as to connect with a purge gas source 930. The purge gas source 930 can be a reservoir, such as a tank or the like, for storing purge gas at a high pressure. Purge gas can be, for example, an inert gas such as nitrogen or the like.

As is seen, the off-gas portion 130 can include at least one purge valve 937 which defines at least a portion of the off-gas passageway 131 and which is configured to regulate the flow of fluid there through. Preferably, the purge gas valve 937 is a regulator which is configured to regulate the release of high pressure purge gas from the purge gas source 930. For example, the purge valve 937 can be configured to regulate the flow of fluid from the purge gas source 930 into the off-gas passageway 131.

In addition to the fill portion 120, and the off-gas portion 130, the apparatus 100 comprises a snift portion 140. The snift portion is configured to convey fluid between the internal chamber"IC" of the container"GB" and the atmosphere "ATM." Preferably, the snift portion 140 can define a snift passageway 141 which is at least partially supported by the filling head 910 and which snift passageway terminates at a snift opening 942. More preferably, the snift opening 942 is configured to fluidly communicate with the internal chamber "IC" of the container "GB" when the fill head 910 is in the fill position.

The snift passageway can be configured as a duct or the like and is configured to convey fluid therein. As is seen, the snift passageway 141 can have a snift vent opening 949 which leads to the atmosphere "ATM." That is, gaseous fluid material can escape from the internal chamber "IC" of the container "GB" through the snift vent opening 949 by way of the snift passageway 141. The snift portion 140 can further comprise a snift valve 946 which defines at least a portion of the snift passageway 141 and which is configured to regulate the flow of fluid there through.

Figure 5A:
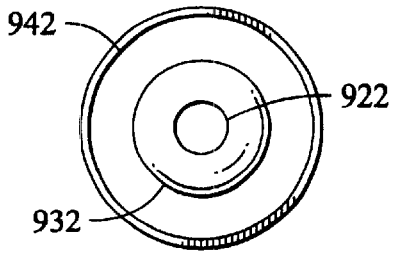
FIG. 5A is a sectional view of the apparatus depicted in FIG. 5.

Moving briefly to FIG. 5A, a view 5A—5A is shown of the fill opening 922, the off-gas opening 932, and the snift opening 942, all of which are described above. As is evident, the respective openings 922, 932, 942 are preferably configured to be substantially concentric with one another as shown. Such a substantially concentric arrangement of the openings 922, 932, 942 can facilitate an optimal cross-sectional area of the portions of the apparatus 100, as well as those portions of other apparatus which are described below, which protrude into containers having relatively small, substantially round openings. It is understood, however, that such a concentric orientation of the openings 922, 932, 942 is not necessary to the operation of the apparatus 100 or any other apparatus in accordance with the present invention, and that other non-concentric orientations of the openings are consistent with the various embodiments of the instant invention.

As in the case of the off-gas passageway 131, as described above, the snift passageway 141 can branch out in at least two directions so as to have two or more "legs." As is seen, the snift passageway 141 of the apparatus 100 can be configured to branch so as to lead both to the snift vent opening 949 and to a vacuum source 940. The vacuum source 940 can be any device that can produce a substantial vacuum, including a device such as a vacuum pump or the like.

A vacuum valve 947 is preferably included in the snift portion 140 of the apparatus 100 in the case wherein a vacuum source 940 is so included. The vacuum valve 947 defines at least a portion of the snift passageway 131 and is configured to regulate the flow of fluid there through. For example, the vacuum valve 947 can be configured to regulate the flow of substantially gaseous fluid from the snift passageway 141 to the vacuum source 940 when the vacuum source is producing a vacuum. Thus, the snift portion 130 can be configured to convey substantially gaseous fluid between the internal chamber "IC" and the vacuum source 940. Also, as discussed above, the snift portion 140 can also be configured to convey substantially gaseous fluid between the internal chamber "IC" of the container "GB" and the atmosphere "ATM."

It is understood that any of the valves 926, 936, 937, 946, 947 can be configured to be either manually operated or automatically operated. When I say a device is configured to be "manually operated" I mean configured with a handle, switch, or the like which allows the device to be physically manipulated by a person for operation thereof. When I say a device is configured to be "automatically operated" I mean configured to be operated in response to a signal which is remotely sent to the valve and received thereby. For example, a valve 926, 936, 937, 946, 947 which is configured to be automatically operated can employ an actuator or the like (not shown), such as a solenoid, to operate the valve in response to remotely sent signals which are received by the valve. The signals can originate from any device capable of generating such signals.

As is evident, the liquid product reservoir 915 can be located relative to the filling head 910 so as to cause the liquid product "PR" to flow into the container "GB" under the force of gravity. Alternatively, as discussed above, the pump 912 or the like can be employed to induce flow of the liquid product "PR" from the reservoir 915 into the container "GB." That is, the pump 912 can be employed to move liquid product "PR" from the liquid product reservoir 915 and out of the fill opening 922. The pump 912 can be configured to be manually operated by way of a manual switch (not shown) or motor control (not shown) or the like. In the alternative, the pump 912 can be configured to be operated automatically by way of a feed-back control loop (not shown), a remotely controlled relay (not shown), or the like.

The apparatus 100 can include at least one pressure sensor 960 which is configured to detect and measure either relative or absolute pressure within a corresponding passageway 120, 130, 140. That is, at least one pressure sensor 960 can be included in the apparatus 100, wherein each pressure sensor is configured to measure the pressure within a given passageway 120, 130, 140. Alternatively, a given pressure sensor 960 can be configured to selectively, or simultaneously, measure the pressure within two or more passageways 120, 130, 140.

The pressure sensor 960 can be one of a number of configurations, including those of a pressure gauge and a pressure sending unit. For example, the apparatus 100 is depicted in FIG. 5 as including a single pressure sensor 960 which is configured to detect and measure pressure within the off-gas passage 130. The pressure sensor 960 is further depicted as a gauge which is configured to visually display the measured pressure within the off-gas passage 130. It is understood, however, that the pressure sensor 960 can be alternatively configured as a pressure sending unit which converts the measured pressure into a signal that can be transmitted, or otherwise sent, to a remote location where it is received.

The apparatus 100 can comprise a controller 950 which is configured to control operational functions of one or more components of the apparatus 100. The controller 950 can be in signal communication with one or more components of the apparatus 100 via communication links 952. By "signal communication" I mean communicably linked so that signals can be transmitted and received between the controller 950 and one or more communicably linked objects. The communication links 952 can comprise any of a number of means of transmitting a signal between two points, including wire transmission, fiber optic transmission, electromagnetic air wave transmission, sonic wave transmission, and the like. The controller 950 can be, for example, a programmable logic device.

As shown, the controller 952 can be in signal communication with each of the fill valve 926, the off-gas valve 936, the purge valve 937, the snift valve 946, and the vacuum valve 947. In addition, the controller 950 can be in signal communication with any of a number of other components of the apparatus 100 such as the vacuum source 940, the pressure sensor 960, and the pump 912 as shown. Such signal communication between the controller 950 and a given component can enable the controller to precisely control and coordinate various operational parameters of the apparatus 100 in accordance with predetermined guidelines as will be more fully discussed below.

It is understood that the controller 950 can be in signal communication with other components of the apparatus 100, or other components of other apparatus in accordance with alternative embodiments of the instant invention which are not shown. For example, in an alternative embodiment of the instant invention which is not shown, the controller 950 can be in signal communication with the filling head 910, and can further be in signal communication with an actuator or the like (not shown) for moving the filling head 910 relative to the container "GB."

Preferably, as discussed above, the controller 950 can be employed to facilitate the operation of each of the valves 926, 936, 937, 946, 947. That is, the controller 950 can be configured to cause any of the valves 926, 936, 937, 946, 947 to modulate, actuate, or otherwise operate so as to regulate the flow of fluid material there through. For example, the controller 950 can be configured to cause any of the valves 926, 936, 937, 946, 947 to modulate in conjunction with an actuator (not shown) and an automatic feedback control system (not shown) in order to maintain a given flow rate of a fluid material through the valve.

Likewise, the controller 950 can be employed to regulate the operation of the pump 912 as well as the operation of the vacuum source 940. For example, the controller 950 can be configured to regulate the speed of the pump 912 in order to maintain a give pressure within the fill passage 120 and downstream of the pump. Similarly, the controller 950 can be configured to turn the vacuum source 940 on and off as required.

It is understood that, although a controller 950 is shown and described herein for regulating various operational aspects of the apparatus 100, the inclusion of the controller in the apparatus is optional. That is, in the alternative, the controller 950 can be deleted from the apparatus 100 and can be replaced by manual controls. For example, rather than employing the controller 950 along with various actuators and feed back control systems to operate the valves 926, 936, 937, 946, 947, the valves can be fitted with manual handles or the like to facilitate manual manipulation of the valves for operation thereof as discussed above.

That is, alternatively, each of the valves 926, 936, 937, 946, 947 can be configured to be opened, closed, or throttled, by way of manual operation rather than automatic operation by way of the controller 950. Likewise, each of the other various components of the apparatus 100 can be alternatively operated manually rather than by way of the controller 950. For example, the pump 912 can be operated by way of a manual switch or the like, as can the vacuum source 940. Likewise, the pressure sensor 960 can be visually monitored. Additionally, any of the components of the apparatus 100 can be configured to be both manually and automatically operated. The operational aspects of the apparatus 100 will be more fully described below.

Figure 5B:
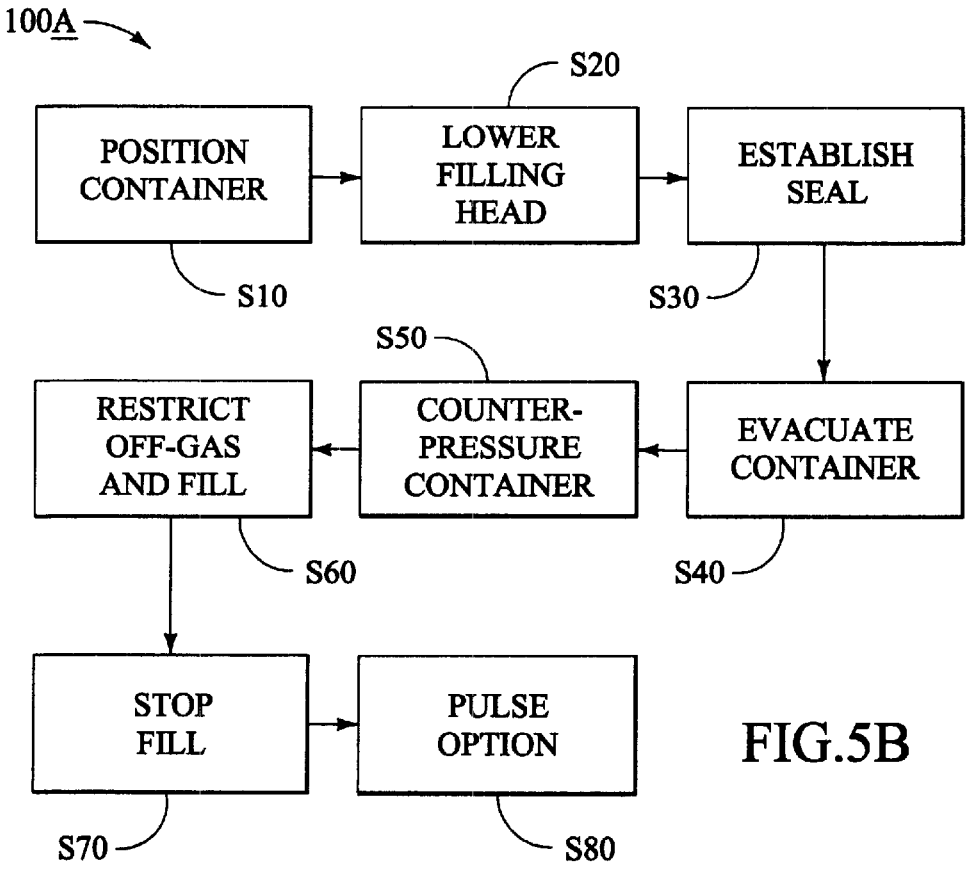
FIG. 5B is a flow chart which represents a possible operational scheme for the apparatus depicted in FIG. 5.

Turning now to FIG. 5B, a flow chart 100A is shown which depicts an embodiment of an operational scheme which can be employed in conjunction with the operation of the apparatus 100 (shown in FIG. 5) as well as other apparatus in accordance with other embodiments of the instant invention, some of which are described below following the description for FIG. 5B. As is shown in FIG. 5B, the flow chart 100A comprises a series of sequential steps S10 through S80. Referring now to FIGS. 5 and 5B, and in accordance with the first step S10, the container "GB" is positioned relative to the filling head 910 so that the filling head and the container are in substantial alignment for movement of the filling head and container relative to one another into the filling position.

Moving to step S20 of the flow chart 100A, the filling head 910 is lowered into the fill position wherein the flow of liquid product "PR" into the chamber "IC" of the container "GB" can commence. When in the fill position, the fill opening 922, the off-gas opening 932, and the snift opening 942, are exposed to the internal chamber "IC" of the container "GB" so that fluid can pass into and out of the container through each of the openings. Preferably, when the filling head 910 is in the fill position, the fill opening 922 is located proximate the lower end "LE" of the container "GB." That is, preferably, the fill portion 120 protrudes into the chamber "IC" proximate the lower end "LE" of the container "GB" as shown when the filling head 910 is in the fill position.

Preferably, the off-gas portion 130 protrudes into the chamber "IC" so that the offgas opening 932 is located substantially near the ideal liquid product fill level within the chamber "IC" of the container "GB" when the filling head 910 is located in the fill position. That is, the off-gas opening 932 is preferably located at an elevation relative to the container "IC" which is substantially close to the elevation at which the surface of the liquid product "PR" is located when the container is filled to the proper level and when the filling head 910 is located in the fill position relative to the bottle.

Also, the snift opening 942 is preferably located substantially near the opening to the container "GB" defined by the lip "LP" of the container. The snift opening 942 is also preferably located above the off-gas opening 932 when the filling head 910 is in the fill position and the off-gas opening 932 is preferably located above the fill opening when the filling head 910 is in the fill position.

It is understood that, while it is preferable to lower the apparatus 100, or at least the filling head 910, into the fill position, an equally acceptable practice is to keep the filling head stationary while raising the container "GB" into the fill position. In either case, the effect is to move the container "GB" with respect to the filling head 910 so that the container and filling head are placed into the fill position. Furthermore, it is understood that the apparatus 100 can be configured so that only the filling head 910 is movable, along with the appropriate portions of the passageways 121, 131, 141 which are supported by the filling head.

That is, the apparatus 100 can be configured so that the filling head 910, along with a portion of each of the passageways 121, 131, 141, is configured to move independently of the remainder of the apparatus, including the various valves 926, 936, 937, 946, 947, reservoirs 915, 930, vacuum source 940, and controller 950. In that case, a portion of each of the passageways 121, 131, 141 can comprise flexible tubing or flexible joints or the like (not shown) so as to allow independent movement of the filling head 910 relative to the remainder of the apparatus 100.

Moving now to step S30 of the flow chart 100A, a seal is established between the filling head 910 and the lip "LP" of the container "GB." That is, when the apparatus 100 is in the fill position, the filling head 910 is in contact with the lip "LP" of the container "GB" as shown so as to substantially seal the chamber "IC" from the atmosphere "ATM." More preferably, the apparatus 100 comprises the seal 912 which, when the filling head 910 is in the fill position, is at least slightly compressed between the filling head and the lip "LP" of the container "GB" so as to create a substantially air-tight seal there between.

Now referring to step S40 of the flow chart A100, the container "GB" is evacuated. The evacuation of the container "GB" can be accomplished by maintaining the valves 926, 936, 937, 946, 947 in respective closed positions as the apparatus 100 attains the fill position. Once the fill position is attained and the seal is established between the lip "LP" and filling head 910, then the vacuum source 940 is turned on. The vacuum valve 947 is then opened to allow the vacuum source 940 to "pull a vacuum" on the container "GB" by way of the appropriate passage. Alternatively, the vacuum source 940 can remain on while the vacuum valve is opened to apply a vacuum to the chamber "IC."

The evacuation of the container "GB" by way of the vacuum source 940, causes substantially all atmospheric gases to be removed from the container. Once the container "GB" has been evacuated, the vacuum valve 947 can be closed. A pressure sensor (not shown) can be included in either the apparatus 100, and can be employed cause the vacuum source 940 to turn off when the desired level of vacuum within the container "GB" is reached.

Moving now to step S50 of the flow chart A100, the container "GB" is counter pressured, or filled with purge gas from the purge gas reservoir 930. Purge gas can be an inert gas such as Nitrogen or the like. The counter-pressuring of the container "GB" can be accomplished by opening the purge gas valve 937 to allow the purge gas which is stored within the purge gas reservoir 930 to flow from the purge gas reservoir into the container "GB" by way of the off-gas passageway 130 and through the off-gas opening 932. The pressure of the purge gas within the container "GB" can be monitored by employment of the pressure sensor 960. When the pressure of the purge gas within the container "GB" reaches a given predetermined level, the purge gas valve 937 can be closed.

The next step in the flow chart A100 is step S60 in which the container "GB" is filled with liquid product "PR" while the flow of off-gas is restricted. This step can be accomplished by causing the pump 912 to turn on and by causing the fill valve 926 to open. This will cause liquid product "PR" to flow from the liquid product reservoir 915 to the chamber "IC" of the container "GB" by way of the fill passage 120. That is, the liquid product "PR" will flow out of the liquid product reservoir 915, through the fill passage 120, out of the fill opening 922, and into the chamber "IC" of the container "GB." As the liquid product "PR" flows into the container "GB" the pressure within the chamber "IC" will initially increase because the purge gas within the container cannot escape there from.

The off-gas valve 936 can then be opened so as to regulate, in a controlled manner, the flow of purge gas from the container "GB." That is, the off-gas valve 936 is opened slightly to allow the off-gas within the container "GB" to "bleed off" at a controlled rate as the container fills with liquid product "PR." This bleed off of the purge gas from the chamber "IC" in turn permits an additional element of control of the rate of fill of the container, since flow of the liquid product "PR" into the container is affected by the internal pressure thereof, and is thus affected by the rate of bleed-off of purge gas through the purge valve 936.

Moving now to step S70 of the flow chart A100, the fill of the container "GB" is stopped when the liquid product "PR" reaches the proper level within the container. Once the proper level of liquid product "PR" is attained within the container "GB," the fill valve 926 can be closed, and the pump 912 can be shut off. Alternatively, the fill valve 926 can be closed while the pump 912 is allowed to run continuously.

If excess liquid product "PR" is pumped into the container "GB" the excess liquid can escape from the chamber "IC" by entering the off-gas passage though the off-gas opening 932. The excess liquid product "PR" can then travel through the off-gas passage 130 and enter the liquid trap 920. The excess liquid product "PR" is captured within the liquid trap 920 while any excess gaseous pressure is allowed to escape from the chamber "IC" through the off-gas vent opening 921. The off-gas valve 936 can then be closed.

The next step of the flow chart A100 is step S80, the pulse option. As is evident, step S80 is an optional step which can be performed at the end of a fill cycle to cause the liquid product "PR" to foam prior to capping or sealing of the container "GB" as in the case of a carbonated liquid product "PR" or the like. The pulse, in accordance with step S80, can be accomplished by quickly and fully opening, and then quickly closing, the purge gas valve 947. This will allow a pulse of purge gas to flow from the purge gas reservoir 930 through the off-gas passageway and out of the off-gas opening 932 and into the chamber "IC."

The pulse of purge gas released from the purge reservoir 930 can cause the liquid product "PR" to foam, especially in the case of a liquid product which contains a dissolved gas, such as in the case of beer which contains dissolved carbon dioxide. The snift valve 946 can be opened immediately after the pulse of purge gas is released into the container "GB" so as to allow the excess pressure within the container to equalize with the atmospheric pressure. Alternatively, the snift valve 946 can be open during release of the pulse of purge gas into the container "GB." In either case, the preferable result is to enable the pulse of purge gas to escape from the chamber "IC" to the atmosphere "ATM" through the snift opening 141.

At the completion of step S70, or alternatively at the completion of optional step S80, the filling head 910 can be removed from the fill position wherein the fill portion 120, and the off gas portion 130, are withdrawn from the chamber "IC" and whereupon the container "GB" can be capped or otherwise sealed. The above-described process can then be repeated continually to fill a succession of containers "GB."

Figure 6:
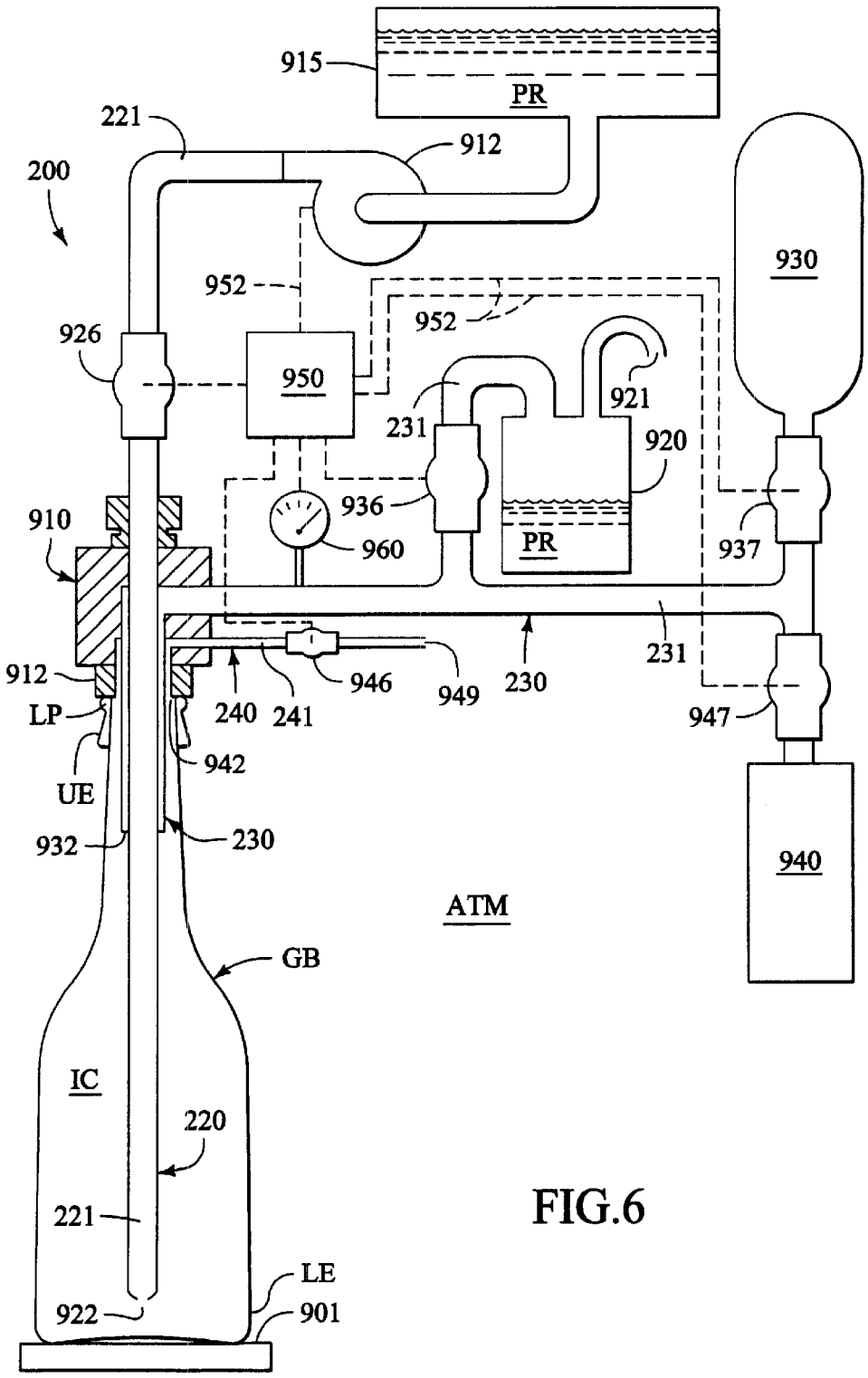
FIG. 6 is a side elevation schematic diagram of an apparatus for filling a container with liquid in accordance with a second embodiment of the present invention.

Turning now to FIG. 6, a schematic diagram is shown which depicts an apparatus 200 in accordance with a second embodiment of the instant invention. The apparatus 200 is similar to the apparatus 100 which is described above for FIG. 5. That is, the apparatus 200, shown in FIG. 6, is an apparatus for filling an internal chamber "IC" of a container "GB" with a liquid product "PR" as in the case of the apparatus 100. The container "GB" has been described above for the apparatus 100.

The apparatus 200 comprises a fill portion 220 which is configured to convey fluid substantially between a liquid product reservoir 915 and the internal chamber "IC" of the container "GB." The configuration and operational aspects of the liquid product reservoir 915 have been discussed above for the apparatus 100. The apparatus 200 also comprises an offgas portion 230 which is configured to convey fluid substantially between the internal chamber "IC" of the container "GB" and a liquid trap 920. The configuration and operational aspects of the liquid trap 920 have been discussed above for the apparatus 100. The apparatus 200 also comprises a snift portion 240 that is configured to convey substantially gaseous fluid between the internal chamber "IC" of the container "GB" and the atmosphere "ATM."

Preferably, the off-gas portion 230 of the apparatus 200 is also configured to convey fluid between the internal chamber "IC" of the container "GB" and a vacuum source 940. The configuration and operational aspects of the vacuum source 940 have been discussed above for the apparatus 100. Additionally, the off-gas portion 230 of the apparatus 200 is also preferably configured to convey fluid between a purge gas source 930 and the internal chamber "IC" of the container "GB." The configuration and operational aspects of the purge gas source 930 have been discussed above for the apparatus 100.

As is evident, the apparatus 200 can be configured so that the off-gas portion 230 is configured to convey purge gas from the purge gas source 930 to the internal chamber "IC" of the container "GB." It is likewise evident that the apparatus 200 can be configured to that the off gas portion 230 is configured to convey gaseous material from the internal chamber "IC" of the container "GB" to the vacuum source 940. It is evident also that this latter aspect of the apparatus 200 serves to differentiate the apparatus 200 from the apparatus 100 which is discussed above.

The fill portion 220 preferably defines a fill passageway 221 which terminates at a fill opening 922. The fill opening 922 has been discussed above for the apparatus 100. Preferably, the fill passageway 221 is a laminar passageway. The off-gas portion 230 preferably defines an off-gas passageway 231 which terminates at an offgas opening 932 which has been discussed above for the apparatus 100. Likewise, the snift portion 240 preferably defines a snift passageway 241 which terminates at a snift opening 942. The snift opening 942 has been discussed above for the apparatus 100.

As is further evident from FIG. 6, the apparatus 200 can comprise other components such as a pump 912, a pressure sensor 960, a controller 950, and at least one communication link 952. The relative location, configuration, and operational aspects of these components has been discussed above for the apparatus 100. The apparatus 200 can also comprise additional components such as at least one each of a fill valve 926, an off-gas valve 936, a purge valve 937, a snift valve 946, and a vacuum valve 947. The relative location, configuration, and operational aspects of such valves have been discussed above for the apparatus 100.

As is evident from a study of FIGS. 5 and 6, the configuration and operation of the apparatus 200 can be similar to that of the apparatus 100 which is described above with the exception that, in the case of the apparatus 200, the vacuum source 940 is connected to the off-gas portion 230 rather than the snift portion 240 as in the case of the apparatus 100.

Figure 7:
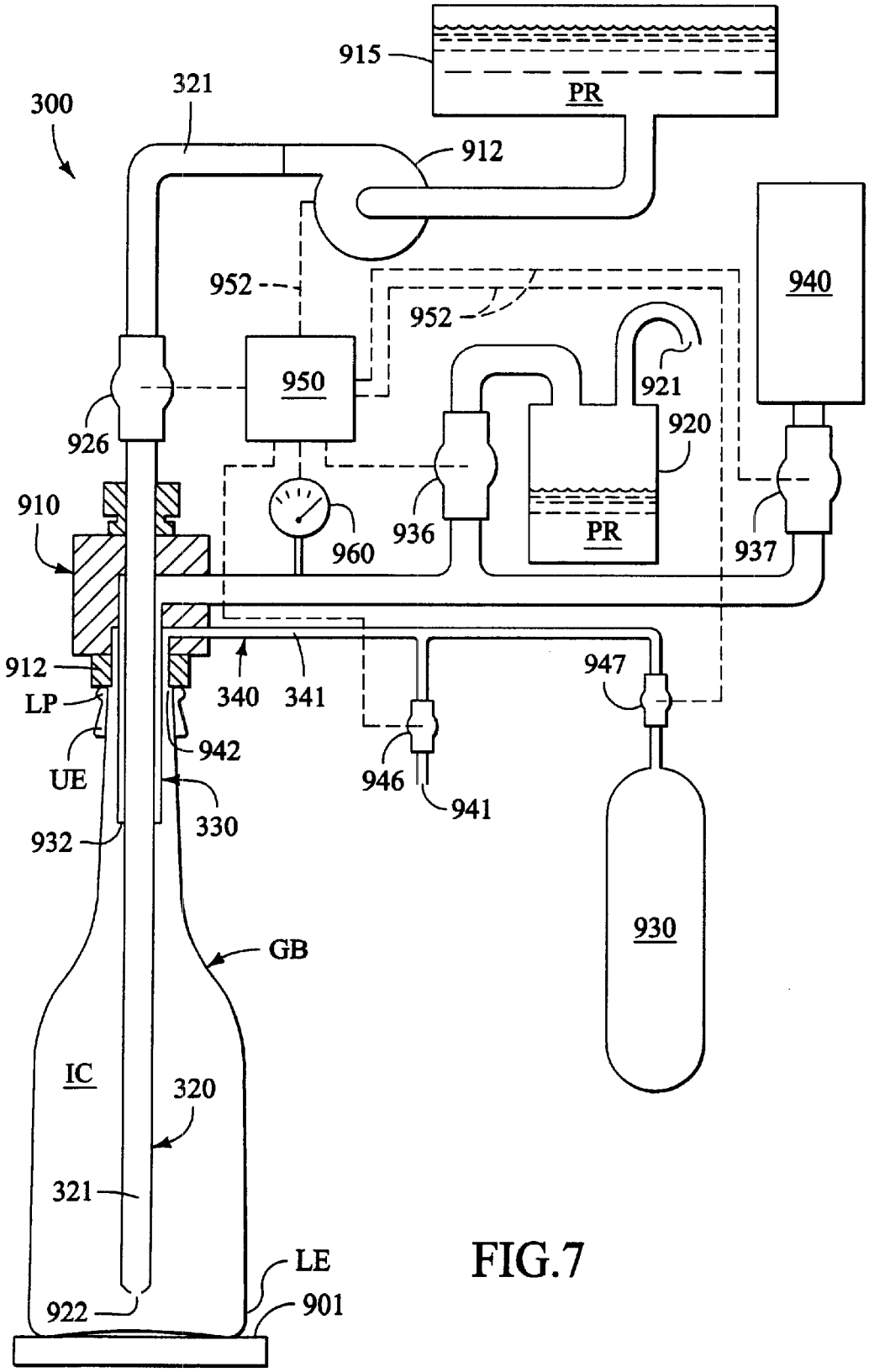
FIG. 7 is a side elevation schematic diagram of an apparatus for filling a container with liquid in accordance with a third embodiment of the present invention.

Turning now to FIG. 7, a schematic diagram is shown which depicts an apparatus 300 in accordance with a third embodiment of the instant invention. The apparatus 300 is similar to the apparatus 100 and 200 which are described above for FIGS. 5 and 6 respectively. That is, the apparatus 300, shown in FIG. 7, is an apparatus for filling an internal chamber "IC" of a container "GB" with a liquid product "PR" as in the case of the apparatus 100 and 200. The nature and configuration of the container "GB" has been described above for the apparatus 100.

The apparatus 300 comprises a fill portion 320 which is configured to convey fluid substantially between a liquid product reservoir 915 and the internal chamber "IC" of the container "GB." The configuration and operational aspects of the liquid product reservoir 915 have been discussed above for the apparatus 100. The apparatus 300 also comprises an off-gas portion 330 which is configured to convey fluid substantially between the internal chamber "IC" of the container "GB" and a liquid trap 920. The configuration and operational aspects of the liquid trap 920 have been discussed above for the apparatus 100. The apparatus 300 also comprises a snift portion 340 that is configured to convey fluid between the internal chamber "IC" of the container "GB" and the atmosphere "ATM."

Preferably, the off-gas portion 330 of the apparatus 300 is also configured to convey substantially fluid between the internal chamber "IC" of the container "GB" and a vacuum source 940. The configuration and operational aspects of the vacuum source 940 have been discussed above for the apparatus 100. Also, preferably the snift portion 340 of the apparatus 300 is configured to convey fluid between a purge gas source 930 and the internal chamber "IC" of the container "GB." The configuration and operational aspects of the purge gas source 930 have been discussed above for the apparatus 100.

As is evident, the apparatus 300 can be configured so that the snift portion 340 is configured to convey purge gas from the purge gas source 930 to the internal chamber "IC" of the container "GB." It is likewise evident that the apparatus 300 can be configured to that the off-gas portion 330 is configured to convey gaseous material from the internal chamber "IC" of the container "GB" to the vacuum source 940. It is evident also that these aspects of the apparatus 300 serve to differentiate the apparatus 300 from both the apparatus 100 and the apparatus 200 which are discussed above.

The fill portion 320 preferably defines a fill passageway 321 which terminates at a fill opening 922. The fill opening 922 has been discussed above for the apparatus 100. Preferably, the fill passageway 321 is a laminar passageway. The off-gas portion 330 preferably defines an offgas passageway 331 which terminates at an off-gas opening 932 which has been discussed above for the apparatus 100. Likewise, the snift portion 340 preferably defines a snift passageway 341 which terminates at a snift opening 942. The snift opening 942 has been discussed above for the apparatus 100.

As is further evident from a study of FIG. 7, the apparatus 300 can comprise other components such as a pump 912, a pressure sensor 960, a controller 950, and at least one communication link 952. The relative location, configuration, and operational aspects of these components have been discussed above for the apparatus 100. The apparatus 300 can also comprise additional components such as at least one each of a fill valve 926, an off-gas valve 936, a purge valve 937, a snift valve 946, and a vacuum valve 947. The relative location, configuration, and operational aspects of such valves have been discussed above for the apparatus 100.

As is evident from a study of FIGS. 5, 6, and 7, the configuration and operation of the apparatus 300 can be nearly identical to that of the apparatus 100 which is described above with the exception that, in the case of the apparatus 300, the relative respective locations of the vacuum source 940 and the purge gas source 930 are reversed. That is, in the case of the apparatus 300, the purge gas source 930 can be connected to the snift portion 340 and the vacuum source 240 can be connected to the off-gas portion 330. In comparison, in the case of the apparatus 100, the purge gas source 930 can be connected to the off-gas portion 330 and the vacuum source 240 can be connected to the snift portion 340.

Figure 8:
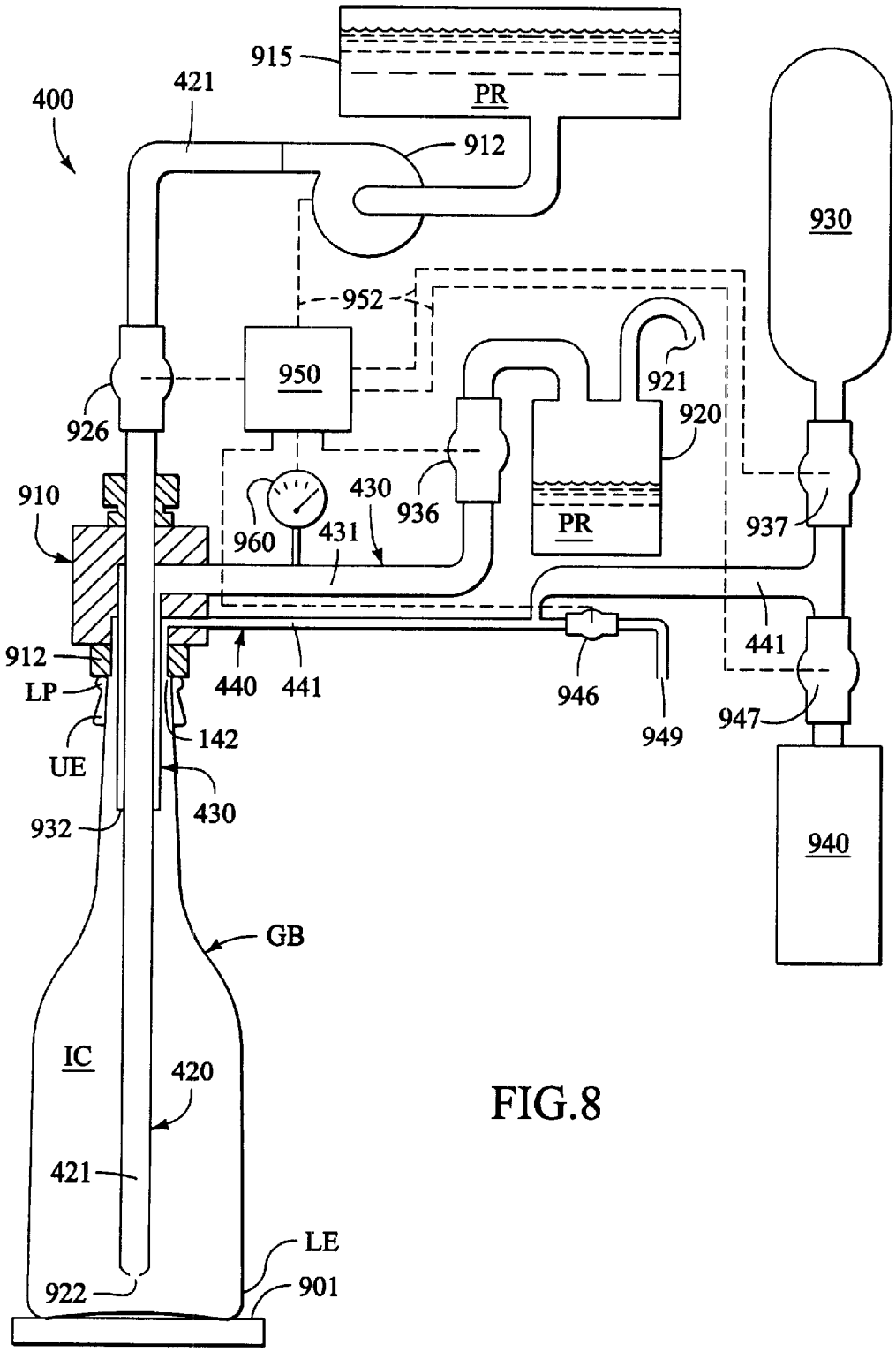
FIG. 8 side elevation schematic diagram of an apparatus for filling a container with liquid in accordance with a fourth embodiment of the present invention.

Turning now to FIG. 8, a schematic diagram is shown which depicts an apparatus 400 in accordance with a fourth embodiment of the instant invention. The apparatus 400 is similar to the apparatus 100,200, and 300 which are described above for FIGS. 5, 6, and 7 respectively. That is, the apparatus 400, shown in FIG. 8, is an apparatus for filling an internal chamber "IC" of a container "GB" with a liquid product "PR" as in the case of the apparatus 100, 200, and 300. The nature and configuration of the container "GB" has been described above for the apparatus 100.

The apparatus 400 comprises a fill portion 420 which is configured to convey fluid substantially between a liquid product reservoir 915 and the internal chamber "IC" of the container "GB." The configuration and operational aspects of the liquid product reservoir 915 have been discussed above for the apparatus 100. The apparatus 400 also comprises an off-gas portion 430 which is configured to convey fluid substantially between the internal chamber "IC" of the container "GB" and a liquid trap 920. The configuration and operational aspects of the liquid trap 920 have been discussed above for the apparatus 100. The apparatus 400 also comprises a snift portion 440 that is configured to convey fluid between the internal chamber "IC" of the container "GB" and the atmosphere "ATM."

Preferably, the snift portion 440 of the apparatus 400 is also configured to convey fluid between the internal chamber "IC" of the container "GB" and a vacuum source 940. The configuration and operational aspects of the vacuum source 940 have been discussed above for the apparatus 100. Also, preferably the snift portion 440 of the apparatus 400 is further configured to convey fluid between a purge gas source 930 and the internal chamber "IC" of the container "GB." The configuration and operational aspects of the purge gas source 930 have been discussed above for the apparatus 100.

As is evident, the apparatus 400 can be configured so that the snift portion 440 is configured to convey purge gas from the purge gas source 930 to the internal chamber "IC" of the container "GB." It is likewise evident that the apparatus 400 can be configured so that the snift portion 440 is also configured to convey gaseous material from the internal chamber "IC" of the container "GB" to the vacuum source 940. It is evident also that these aspects of the apparatus 400 serve to differentiate the apparatus 400 from the apparatus 100, 200 and 300 which are discussed above.

The fill portion 420 preferably defines a fill passageway 421 which terminates at a fill opening 922. The fill opening 922 has been discussed above for the apparatus 100. Preferably, the fill passageway 421 is a laminar passageway. The off-gas portion 430 preferably defines an off-gas passageway 431 which terminates at an off-gas opening 932 which has been discussed above for the apparatus 100. Likewise, the snift portion 440 preferably defines a snift passageway 441 which terminates at a snift opening 942. The snift opening 942 has been discussed above for the apparatus 100.

As is further evident from a study of FIG. 8, the apparatus 400 can comprise other components such as a pump 912, a pressure sensor 960, a controller 950, and at least one communication link 952. The relative location, configuration, and operational aspects of these components have been discussed above for the apparatus 100. The apparatus 300 can also comprise additional components such as at least one each of a fill valve 926, an off-gas valve 936, a purge valve 937, a snift valve 946, and a vacuum valve 947. The relative location, configuration, and operational aspects of such valves have been discussed above for the apparatus 100.

As is evident from a study of FIGS. 5, and 8, the configuration and operation of the apparatus 400 can be nearly identical to that of the apparatus 100 which is described above with the exception that, in the case of the apparatus 400, the relative respective locations of the vacuum source 940 and the purge gas source 930 are reversed from those in the case of the apparatus 100. That is, in the case of the apparatus 400, the purge gas source 930 can be connected to the snift portion 440 and the vacuum source 940 can also be connected to the snift portion 440. In comparison, in the case of the apparatus 100, the purge gas source 930 can be connected to the off-gas portion 130 and the vacuum source 240 can also be connected to the off-gas portion 140.

In accordance with a fifth embodiment of the present invention, a method is disclosed for filling the internal chamber of a container with a liquid product. The method includes evacuating the internal chamber of the container and introducing liquid product into the container. The method can include sealing the container from the atmosphere during filling thereof. This can be accomplished, for example, by providing a filling head which is configured to contact the container in a manner which seals the container from the atmosphere. The container can be filled with purge gas after evacuation of the container and prior to filling thereof with liquid product. An off-gas passageway can be provided through which the purge gas can enter and exit the container.

If the container is filled with purge gas prior to filling, the flow of the purge gas out of the container can be regulated as the purge gas is displaced by incoming liquid product during filling of the container. The purge gas can be released from the container through the purge gas passageway. Alternatively, a snift passageway can be provided through which the purge gas can exit the container. Once the container is filled with liquid product, a pulse of purge gas can be released into the internal chamber of the container so as to cause foaming of the liquid product within the container. The pulse of purge gas can be released into the container through the off-gas passageway. Alternatively, the pulse of purge gas can be released into the container through the snift passageway. Likewise, the pulse of purge gas can be vented to the atmosphere through the snift passage, or in the alternative, can be vented to the atmosphere through the off-gas passage.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for filling an internal chamber of a container with a liquid product, the apparatus comprising:

a fill portion that is configured to convey fluid substantially between a product reservoir and the internal chamber of the container;

an off-gas portion that is configured to convey fluid substantially between the internal chamber of the container and a liquid trap; and, a snift portion that is configured to convey fluid between the internal chamber of the container and the atmosphere.

2. The apparatus of claim 1, and wherein:

the snift portion is further configured to convey fluid between the internal chamber of the container and a vacuum source; and, the off-gas portion is further configured to convey fluid between a purge gas source and the internal chamber of the container.

3. The apparatus of claim 1, and wherein:

the off-gas portion is further configured to convey fluid between the internal chamber of the container and a vacuum source; and, the off-gas portion is further configured to convey fluid between a purge gas source and the internal chamber of the container.

4. The apparatus of claim 1, and wherein:

the off-gas portion is further configured to convey fluid between the internal chamber of the container and a vacuum source; and, the snift portion is further configured to convey fluid between a purge gas source and the internal chamber of the container.

5. The apparatus of claim 1, and wherein:

the snift portion is further configured to convey fluid between the internal chamber of the container and a vacuum source; and, the snift portion is further configured to convey fluid between a purge gas source and the internal chamber of the container.

6. The apparatus of claim 1, and wherein:

the fill portion defines a fill passageway that terminates at a fill opening;

the off-gas portion defines an off-gas passageway that terminates at an off-gas opening, wherein the off gas opening is above the fill opening; and, the snift portion defines a snift passageway which terminates at a snift opening, wherein the snift opening is above the off-gas opening.

7. The apparatus of claim 6, and wherein:

the snift passageway is a substantially laminar passageway; and, the snift opening is a substantially capillary opening.

8. The apparatus of claim 6, and wherein the snift opening, the off-gas opening, and the fill opening are substantially concentric with one another.

9. An apparatus for filling an internal chamber of a container with a liquid product, the apparatus comprising:

a filling head which is configured to move into and out of a filling position relative to the container;

a filling portion which is at least partially supported by the filling head and which defines a fill passageway which is configured to convey fluid therein, wherein the fill passageway terminates at a fill opening that is configured to fluidly communicate with the internal chamber of the container, wherein the fill opening is within the internal chamber when the filling head is in the filling position;

an off-gas portion which is at.least partially supported by the filling head and which defines an off-gas passageway which is configured to convey fluid therein, wherein the off-gas passageway terminates at an off-gas opening that is configured to fluidly communicate with the internal chamber of the container, wherein the off-gas opening is within the internal chamber when the filling head is in the filling position, and wherein the off-gas opening is above the fill opening;

a snift portion which is at least partially supported by the filling head and which defines a snift passageway which is configured to convey fluid therein, wherein the snift passageway terminates at a snift opening that is configured to fluidly communicate with the internal chamber of the container;

a fill valve which defines at least a portion of the fill passageway and which is configured to regulate the flow of fluid there through;

an off-gas valve which defines at least a portion of the off-gas passageway and which is configured to regulate the flow of fluid there through; and, a snift valve which defines at least a portion of the snift passageway and which is configured to regulate the flow of fluid there through.

10. The apparatus of claim 9, and further comprising:

a liquid product reservoir, wherein the fill portion is configured to convey liquid product from the reservoir to the internal chamber of the container;

a liquid trap, wherein the off-gas portion is configured to convey liquid product from the internal cavity of the container to the liquid trap;

an off-gas vent opening, wherein the off-gas portion is configured to convey gaseous material from the internal cavity of the container and out of the off-gas vent opening to the atmosphere; and, a snift vent opening, wherein the snift portion is configured to convey gaseous material from the internal cavity of the container and out of the snift vent opening to the atmosphere.

11. The apparatus of claim 10, and further comprising:

a purge gas source, wherein the off-gas portion is configured to convey purge gas from the purge gas source to the internal cavity of the container; and, a vacuum source, wherein the snift portion is configured to convey gaseous material from the internal cavity of the container to the vacuum source.

12. The apparatus of claim 10, and further comprising:

a purge gas source, wherein the off-gas portion is configured to convey purge gas from the purge gas source to the internal cavity of the container; and, a vacuum source, wherein the off-gas portion is configured to convey gaseous material from the internal cavity of the container to the vacuum source.

13. The apparatus of claim 10, and further comprising:

a purge gas source, wherein the snift portion is configured to convey purge gas from the purge gas source to the internal cavity of the container; and, a vacuum source, wherein the off-gas portion is configured to convey gaseous material from the internal cavity of the container to the vacuum source.

14. The apparatus of claim 10 and further comprising:

a purge gas source, wherein the snift portion is configured to convey purge gas from the purge gas source to the internal cavity of the container; and, a vacuum source, wherein the snift portion is configured to convey gaseous material from the internal cavity of the container to the vacuum source.

* * * * *